US009444206B2

(12) United States Patent
Kitanishi

(10) Patent No.: US 9,444,206 B2
(45) Date of Patent: Sep. 13, 2016

(54) CONNECTOR STRUCTURE

(71) Applicant: TEAC Corporation, Tokyo (JP)

(72) Inventor: Ryoji Kitanishi, Tokyo (JP)

(73) Assignee: TEAC Corporation, Tokyo (JP)

( * ) Notice: Subject to any disclaimer, the term of this patent is extended or adjusted under 35 U.S.C. 154(b) by 0 days.

(21) Appl. No.: 14/877,537

(22) Filed: Oct. 7, 2015

(65) Prior Publication Data

US 2016/0104984 A1 Apr. 14, 2016

(30) Foreign Application Priority Data

Oct. 8, 2014 (JP) ..... 2014-207468

(51) Int. Cl.

| | |
|---|---|
| ***H01R 13/625*** | (2006.01) |
| ***H01R 24/86*** | (2011.01) |
| ***H01R 13/627*** | (2006.01) |
| ***H01R 13/639*** | (2006.01) |
| ***H04R 1/06*** | (2006.01) |
| *H01R 13/622* | (2006.01) |
| *H01R 33/72* | (2006.01) |
| *H04R 1/08* | (2006.01) |
| *H01R 105/00* | (2006.01) |

(52) U.S. Cl.

CPC ..... *H01R 24/86* (2013.01); *H01R 13/627* (2013.01); *H01R 13/6275* (2013.01); *H01R 13/639* (2013.01); *H04R 1/06* (2013.01); *H01R 13/622* (2013.01); *H01R 33/72* (2013.01); *H01R 2105/00* (2013.01); *H04R 1/083* (2013.01); *H04R 2420/09* (2013.01)

(58) Field of Classification Search

CPC H01R 24/86; H01R 13/622; H01R 13/6275; H01R 13/639; H01R 13/627; H01R 33/72; H04R 1/083; H04R 1/06; H04R 2420/09

USPC ..... 439/345, 350, 353–357

See application file for complete search history.

(56) References Cited

U.S. PATENT DOCUMENTS

| | | | | |
|---|---|---|---|---|
| 7,806,714 | B2 * | 10/2010 | Williams | H01R 13/639 439/265 |
| 7,892,004 | B2 * | 2/2011 | Hertzler | H01R 13/5219 439/312 |
| 8,192,218 | B2 * | 6/2012 | Sasaki | H01R 13/625 439/320 |
| 2006/0051999 | A1 | 3/2006 | Allemann et al. | |
| 2012/0224736 | A1 | 9/2012 | Akino | |

FOREIGN PATENT DOCUMENTS

| | | | |
|---|---|---|---|
| JP | 6-21170 | U | 3/1994 |
| JP | 2014-035436 | A | 2/2014 |
| WO | 2005/048257 | A1 | 5/2005 |

OTHER PUBLICATIONS

Extended European Search Report, dated Jan. 7, 2016, for corresponding European Application No. 15188956.5-1801, 7 pages.

* cited by examiner

*Primary Examiner* — Khiem Nguyen
(74) *Attorney, Agent, or Firm* — Seed IP Law Group PLLC

(57) ABSTRACT

A connector structure for attaching a hand microphone to a voice recorder 11 includes a recorder-side connector, a pre-load applying member and an operation ring. The pre-load applying member applies a pre-load by pushing a rear end of a connector housing of a mikeside connector while the mikeside connector is joined to the recorder-side connector. The position of the pre-load applying member is adjustable in the axial direction of the recorder-side connector by means of the operation ring, so as to apply a proper pre-load to the mikeside connector, thereby stabilizing the joint regardless of variations in axial length of the mikeside connector. As using no coil spring, the connector structure does not provide repulsion during the attaching operation.

6 Claims, 8 Drawing Sheets

CONNECTOR STRUCTURE

CROSS-REFERENCE TO RELATED APPLICATIONS

This application claims priority under 35 U.S.C §119(a) to Japanese Patent Application No. 2014-207468 filed Oct. 8, 2014. The above application is hereby expressly incorporated by reference, in its entirety, into the present application.

BACKGROUND OF THE INVENTION

1. Field of the Invention

The present invention relates to a connector structure for use in a voice recorder.

2. Description Related to the Prior Art

Voice recorders are known, which are capable of recording voices input through a microphone (refer to JPA 2014-035436). An example of voice recorder has an IC memory for recording audio data as captured through a microphone and a speaker for enabling reproduction of the audio data. This kind of voice recorder may be called IC recorder or the like. Some types of voice recorders have a microphone integrated therein, and other types are provided with an external microphone that is detachably attachable to the recorder body. The voice recorders of those types with an externally attachable microphone are provided with a connector for attaching the external microphone to the recorder body.

As a type of said connector, push-on type is known, for example, from JPU H06-021170. An example of push-on type connector has a connector body with connector terminals, an anti-removal engaging claw provided on the connector body for retaining an object attached thereto, and a coil spring that can expand and contract in the axial direction of the connector body. The coil spring contracts in the axial direction of the connector body as an object to be attached is pushed into the connector body in the axial direction thereof, thereby generating a force biasing the attached object in the opposite direction to the inserting direction, i.e. in the detaching direction. The object to be attached is provided with an engaging hole or the like that is to be engaged with the engaging claw.

The object to be attached is inserted into the connector body against the biasing force of the coil spring till the engaging claw is engaged in the engaging hole. When the engaging claw comes into engagement with the engaging hole, the object to be attached is completely connected to the connector. Then the attached object is moved in the detaching direction by the repulsion due to the resiliency of the coil spring. Thus, a pre-load of the coil spring is applied to the engaging claw and the engaging hole in the axial direction so as to close a gap therebetween.

The push-on type connection thus enables to complete the engagement through the engaging claw only by pushing the attaching object into the connector, making it easy to connect the attaching object. In addition, the push-on type connection applies the pre-load to the engaging hole and the engaging claw by the biasing force of the coil springs, thereby preventing instability or wobbles that may be caused at the joint due to dimensional errors or the like in the connector or the attached object.

A study has been made to attach a hand microphone as an external microphone to a voice recorder such as described in JPA 2014-035436. The hand microphone typically has a substantially cylindrical grip portion, and a microphone main body is mounted on the head of the grip portion, whereas a connector for connecting the hand microphone to a cable (hereinafter referred to as a mikeside connector) is mounted on the tail end of the grip portion. Employing a push-on connector such as described in JPU H06-021170 as a connector of a voice recorder (hereinafter referred to as a recorder-side connector) will make it easy to connect the hand microphone to the voice recorder.

Furthermore, as described above, the push-on type connection prevents the rattles by means of the biasing force of the coil spring. When the hand microphone is attached to the voice recorder, if there is a gap in the joint, the hand microphone will wobble, generating rattles, such as contact noises or friction noises. The larger is the gap, the vibrations become the bigger, and the contact noises or friction noises become the larger. Because the hand microphone will capture the contact noises or friction noises, it is highly necessary to stably retain the hand microphone on the voice recorder.

Meanwhile, the sizes of mikeside connectors of hand microphones greatly vary depending on the types and the manufacturers. Particularly, there are great variations in axial length between mikeside connectors, including the length of a connector housing for accommodating terminal pins of the mikeside connector. The axial length of each mikeside connector has an influence on the amount of thrust into the recorder-side connector. Since the push-on connection provides the engagement by pushing the mikeside connector in the axial direction thereof into the recorder-side connector while compressing the coil spring, the variation in the amount of thrust will lead to changing the pre-load by the coil spring.

With a mikeside connector of a short axial length, the amount of thrust and hence the amount of compression of the coil spring are small, so the repulsive force of the coil spring is weak. The weak repulsive force results in reducing the pre-load on the mikeside connector, lowering the preventive effect against rattles. In contrast, with a mikeside connector of a longer axial length, the amount of thrust and hence the amount of compression of the coil spring are greater, so the repulsive force is stronger. The stronger repulsive force increases the pre-load and enhances the preventive effect against rattles. However, too strong repulsion of the coil spring causes a problem of making the attaching operation uneasy.

SUMMARY OF THE INVENTION

The present invention has an object to provide a connector structure for attaching an external microphone to a voice recorder, which does not provide any repulsion during the attaching operation and ensures prevention against wobbles at the joint even where there are variations in axial length between mikeside connectors.

To achieve the above object in a connector structure for attaching an external microphone to the voice recorder that records sounds and voices, the external microphone inputting sounds and voices to the voice recorder, the connector structure comprises a recorder-side connector, a pre-load applying device, a holder housing and a locking device. The recorder-side connector is provided in the voice recorder so as to be connectable to a mikeside connector of the external microphone, and comprises a connector body having a shaft-like shape, of which a front end portion is to be inserted in a tubular cylindrical connector housing of the mikeside connector, and a second engaging portion which is provided on the connector body so as to be engaged with a first engaging portion of the connector housing when the connector body is inserted in the connector housing, thereby to prevent removal of the mikeside connector from the recorder-side connector. The pre-load applying device applies a pre-load to the connector housing by pushing a rear end face of the connector housing in an axial direction of the connector body while the first engaging portion is engaged with the second engaging portion and the connector housing is located around the outer periphery of the connector body. The holder housing has a tubular cylindrical shape capable of holding a rear end portion of the connector body therein and holds the pre-load applying device thereon so as to be movable in the axial direction. The locking device locks the pre-load applying device at an appropriate axial position on the holder housing.

Preferably, the pre-load applying device is a member of a tubular cylindrical shape that is capable of holding a portion of the connector body therein.

Preferably, the locking device is an operation ring for causing the pre-load applying device to move in the axial direction, the operation ring being placed on the rear side of the pre-load applying device in the axial direction and screwed on the outer periphery of the holder housing such that the operation ring is moved in the axial direction by being turned around the holder housing, thereby enabling to adjust the axial position of the pre-load applying device.

The pre-load applying device is preferably provided with an elastic member on a face end that is brought into contact with the rear end face of the connector housing.

Preferably, the second engaging portion is mounted to be capable of protruding out of and retracting into the outer periphery of the connector body; the connector body is provided with a release member for releasing the engagement of the second engaging portion from the first engaging portion by depressing the second engaging portion into the connector body, the release member being disposed on the rear side of the second engaging portion and protruding outward from the outer periphery of the connector body; the pre-load applying device has such an external diameter that the height of the release member protruding from the outer periphery of the connector body is approximately even with the outer peripheral surface of the pre-load applying device; and a cutout for exposing the release member to be operable from the outside is formed by cutting out a part of a peripheral wall of the pre-load applying device from the front side so as to surround the release member on three sides except the front side.

The connector structure preferably has a rotational amount restriction mechanism for restricting the rotational amount of the operation ring.

The connector structure in accordance with the present invention does not provide any repulsion while the external microphone is being attached to the voice recorder, and ensures prevention against instability of the joint even while there are variations in axial length between mikeside connectors.

BRIEF DESCRIPTION OF THE DRAWINGS

The above and other objects and advantages of the present invention will be more apparent from the following detailed description of the preferred embodiments when read in connection with the accompanying drawings, wherein.

DESCRIPTION OF THE PREFERRED EMBODIMENTS

First Embodiment

Figure 1:
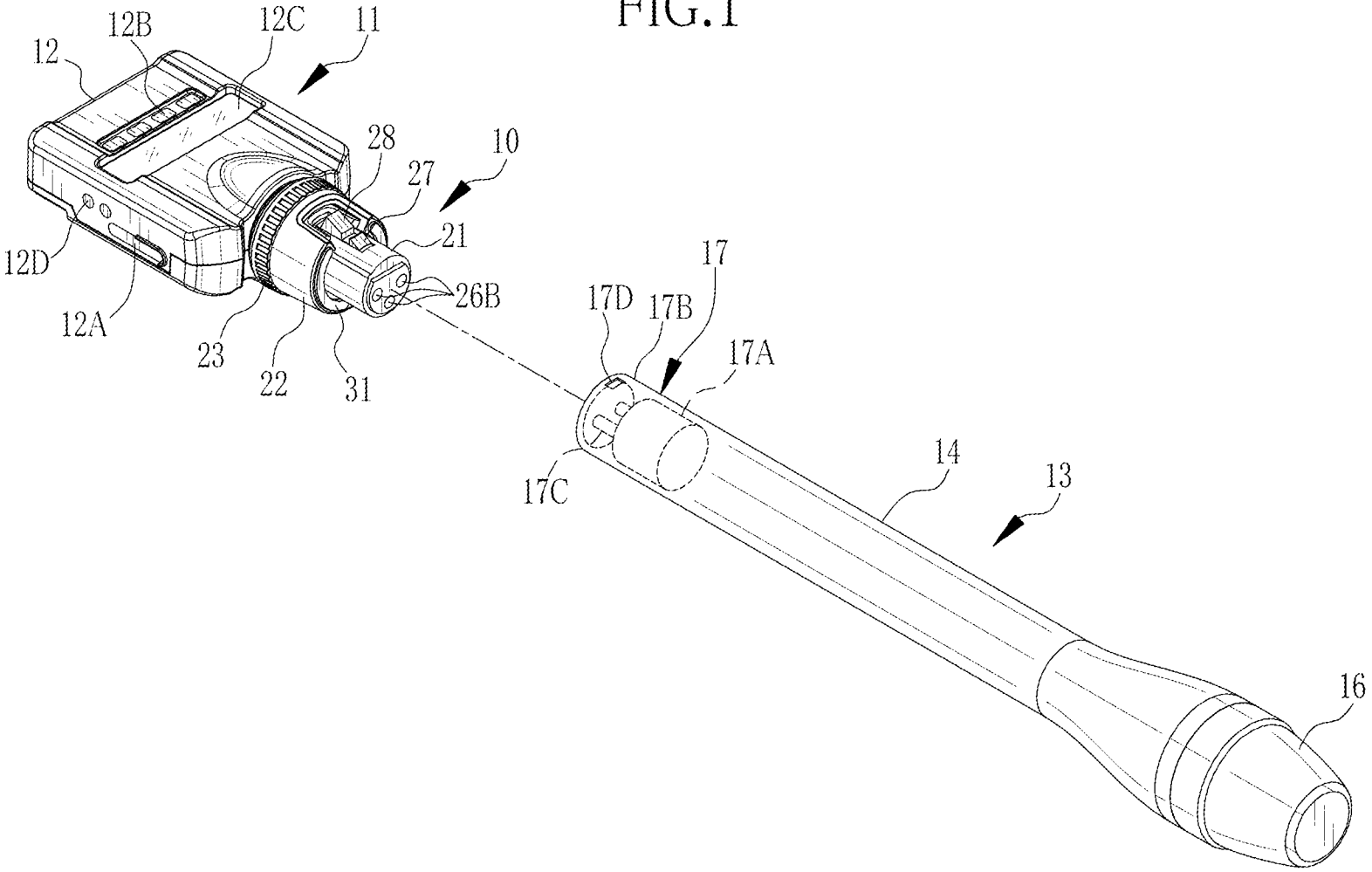
FIG. 1 is a perspective view illustrating an outer appearance of a voice recorder using a connector structure of the present invention therein.
Figure 2:
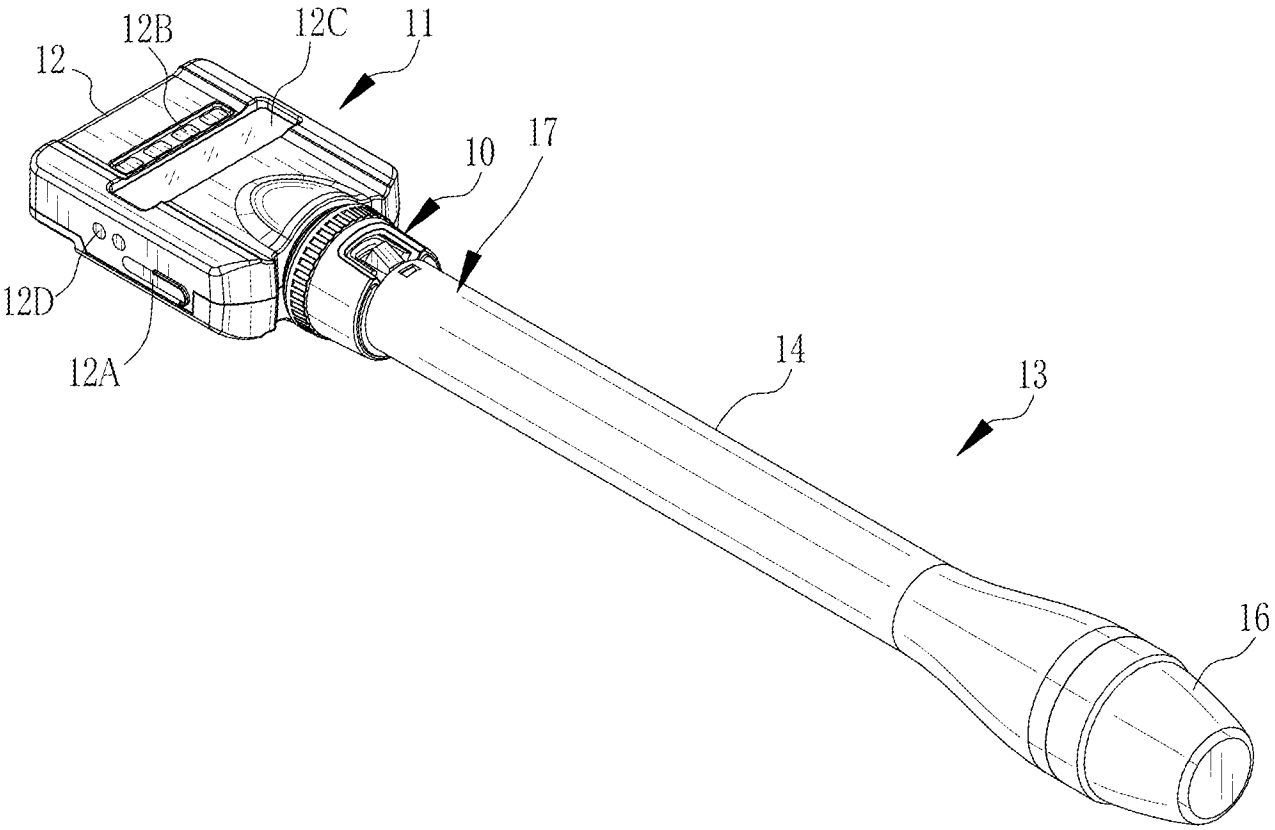
FIG. 2 is a perspective view illustrating an outer appearance of the voice recorder with a hand microphone attached thereto.

In FIGS. 1 and 2, a connector structure 10 of the present invention is used in a voice recorder 11 that is capable of recording input sounds and voices. An external microphone for inputting sounds and voices is detachably attachable to the voice recorder 11, and the connector structure 10 is for attaching such an external microphone. The voice recorder 11 may also be provided with an integrated microphone. As an example, the voice recorder 11 is of a handy portable type, having a data storage device, such as an IC memory, for recording the input sounds or voices in a recorder body 12 (though the data storage device is not shown in the drawings).

In addition, the recorder body 12 is provided with an earphone jack (not shown) and other elements which enable reproduction of audio data recorded in the IC memory. The recorder body 12 may also be provided with an integrated speaker. The recorder body 12 is provided with a power switch 12A, operation buttons 12B for making operations to record or reproduce sounds, an indicator 12C for displaying various indicia, including those indicating the current status of the voice recorder 11, such as reproducing or recording, and the time related to the recording, and a volume control button 12D, etc. The recorder body 12 is further provided with a slot for a memory card for recording the audio data and an USB (universal serial bus) connector for enabling transmission of the recorded audio data to an external device (though both are not shown in the drawings).

The connector structure 10 is for attaching a hand microphone 13 of a wired connection type as an external microphone. The hand microphone 13 has a substantially cylindrical grip portion 14, and a microphone head 16 is mounted on one end of the grip portion 14, whereas a connector (hereinafter referred to as a mikeside connector) 17 is mounted on the other end (tail end) of the grip portion. The mikeside connector 17 is for connecting the hand microphone 16 to a cable in order to output an audio signal that is captured through the microphone head 16. The mikeside connector 17 is normally provided in the wired connection type hand microphone 13. The connector structure 10 is configured to be connectable to the mikeside connector 17. FIG. 2 shows a condition where the hand microphone 13 is attached to the voice recorder 11.

Figure 3:
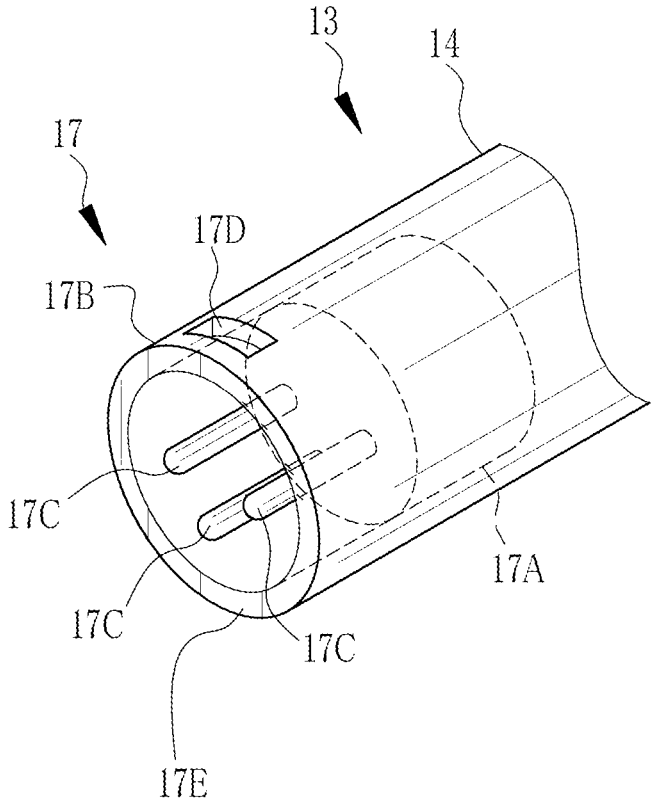
FIG. 3 is an explanatory diagram illustrating a mikeside connector of the hand microphone.

As shown in FIGS. 1 and 3, the mikeside connector 17 is constituted of a connector main body 17A and a connector housing 17B. The connector main body 17A is a male connector with multiple (e.g. three) terminal pins 17C. The terminal pins 17C extend in the axial direction of the grip portion 14 toward the tail end of the hand microphone 13. The connector housing 17B is provided for protecting the terminal pins 17C, and has a substantially tubular cylindrical shape and a length for containing the connector main body 17A including the terminal pins 17C. The connector housing 17B is made of a metal, for example. In the vicinity of the tail end, the connector housing 17B is provided with an engaging hole 17D (corresponding to the first engaging part), which is to be engaged with an engaging part of a recorder-side connector 21, as set forth later.

Although the specifications of the mikeside connector 17, the dimensions among others, are defined according to the standards, there are dimensional variations depending on the manufacturers and the connector types. Such variations are remarkable particularly in external diameter of the mikeside connector 17 and axial length of the connector housing 17B.

Figure 4:
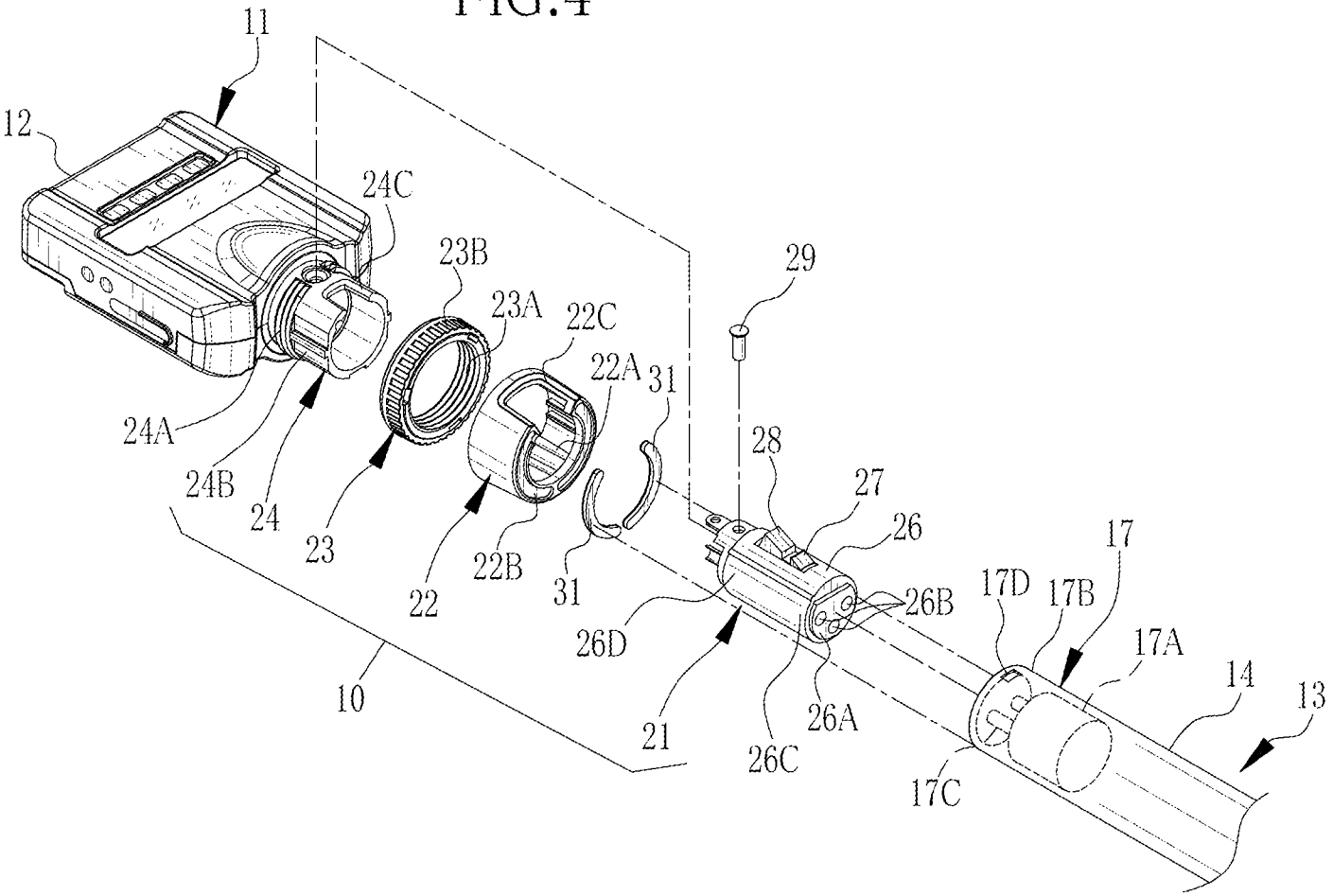
FIG. 4 is an exploded perspective view of the connector structure.

As shown in FIGS. 1 and 4, the connector structure 10 is constituted of the recorder-side connector 21, a pre-load applying member 22, an operation ring 23 and a holder housing 24. The recorder-side connector 21 has a connector body 26 and an engaging claw 27 which is to be engaged in the engaging hole 17D formed in the mikeside connector 17. The connector body 26 and the engaging claw 27 are made of a metal.

The connector body 26 has a shape of a shaft with a round cross-section perpendicular to the axial direction thereof, and has a female terminal 26B of a pin-hole type on a front face 26A thereof. The connector body 26 is connected to the mikeside connector 17 by inserting the front face 26A into the connector housing 17B of the mikeside connector 17. The connector body 26 is inserted in the axial direction thereof into the connector housing 17B. The terminal 26B has holes arranged correspondingly to the terminal pins 17C of the mikeside connector 17, so that the terminal pins 17C will be plugged in these holes.

The engaging claw 27 is the engaging part of the connector structure 10, which is to be engaged in the engaging hole 17D so as to prevent slippage of the mikeside connector 17, and corresponds to the second engaging part. The engaging claw 27 is mounted to be movable between a protruded position and a depressed position, wherein the engaging claw 27 protrudes from the outer peripheral surface of the connector body 26 in the protruded position, and is depressed inwards of the outer peripheral surface in the depressed position. The engaging claw 27 has a substantially right-angled triangular shape in the longitudinal section along the axis of the connector body 26, and has a top surface that slants from the front to the rear side in the inserting direction of the connector body 26 into the connector housing 17B and a rear edge that is approximately perpendicular to the axial direction (refer also to FIG. 5). While the connector body 26 is being inserted into the connector housing 17B, the peak of the engaging claw 27 in the protruded position is located beyond the inner periphery of the connector housing 17B, and the engaging claw 27 is biased toward the protruded position by a (not-shown) spring or the like that is mounted inside the connector body 26.

When the front end 26C of the connector body 26 is inserted in the connector housing 17B, the terminal pins 17C are plugged in the terminal 26B. Simultaneously, the engaging claw 27 enters in the connector housing 17B. At that time, the engaging claw 27 is once depressed toward the depressed position as the top surface thereof is pressed against the inner peripheral surface of the connector housing 17B. Thereafter when the engaging claw 27 gets to the engaging hole 17D, the engaging claw 27 protrudes into the engaging hole 17D according to the biasing force of the spring. Thus, the engaging claw 27 is engaged in the engaging hole 17D. When the mikeside connector 17 is pulled in the direction detaching from the connector body 26, the rear edge of the engaging claw 27 is stopped against the rear rim of the engaging hole 17D. This way, after the engaging claw 27 is engaged in the engaging hole 17D, the mikeside connector 17 is prevented from slipping out.

A release member 28 is provided on the rear side of the engaging claw 27. The release member 28 is for releasing the engagement of the engaging claw 27 from the engaging hole 17D by pressing the engaging claw 27 from the protruded position into the depressed position. For example, the release member 28 is integrally formed with the engaging claw 27. The release member 28 protrudes outward from the outer periphery of the connector body 26 such that the engaging claw 27 is moved from the protruded position to the depressed position by pushing the release member 28 downward. The release member 28 has a substantially triangular shape in the longitudinal section along the axis of the connector body 26, and has a top surface that slants from the front to the rear side (refer also to FIG. 5). The release member 28 is sized larger than the engaging claw 27, and protrudes radially from the connector body 26 more than the engaging claw 27 in the protruded position.

The recorder-side connector 21 is attached to the recorder body 12 of the voice recorder 11 by accommodating a rear end portion 26D of the connector body 26 in the connector holder 24. The connector body 26 is secured to the connector holder 24, for example, by a screw 29.

The connector holder 24 has a substantially tubular cylindrical shape that is capable of holding the connector body 26 therein. The connector holder 24 is made of a plastic resin, for example. The connector holder 24 holds the pre-load applying member 22 and the operation ring 23. A thread 24A is formed around the outer peripheral surface of the connector holder 24 on the rear side thereof, to fit the operation ring 23 on the connector holder 24 through the thread 24A. In addition, guide members 24B are formed on the outer peripheral surface of the connector holder 24. The guide members 24B are flutes or ridges that extend in the axial direction forward from the thread 24A, and are configured to interlock with the inner periphery of the pre-load applying member 22 as fitted on the connector holder 24, thereby to restrict rotational movement of the pre-load applying member 22 around the connector holder 24. Furthermore, a cutout 24C for accepting the release member 28 is also formed in the connector holder 24.

The pre-load applying member 22 is addressed to stabilize the joint by applying a pre-load to the connector housing 17B. Stabilizing the joint also prevents wobbles between the mikeside connector 17 and the recorder-side connector 21, generating no contact noise or friction noise, and thus prevents the hand microphone 13 from capturing such contact noises or friction noises. The pre-load applying member 22 corresponds to the pre-load applying device.

The pre-load applying member 22 is a tubular cylindrical member that is capable of holding a part of the connector body 26, and is fit on the outer periphery of the connector holder 24 and held thereon. The pre-load applying member 22 is mounted movable in the axial direction on the connector holder 24, so that the pre-load applying member 22 is movable relative to the connector body 26 that is secured to the connector body 26. The pre-load applying member 22 has guide members 22A provided on the inner periphery so as to interlock with the guide members 24B of the connector holder 24. The interlocked guide members 24B and 22A restrict rotational movement of the pre-load applying member 22 around the connector holder 24.

Figure 5:
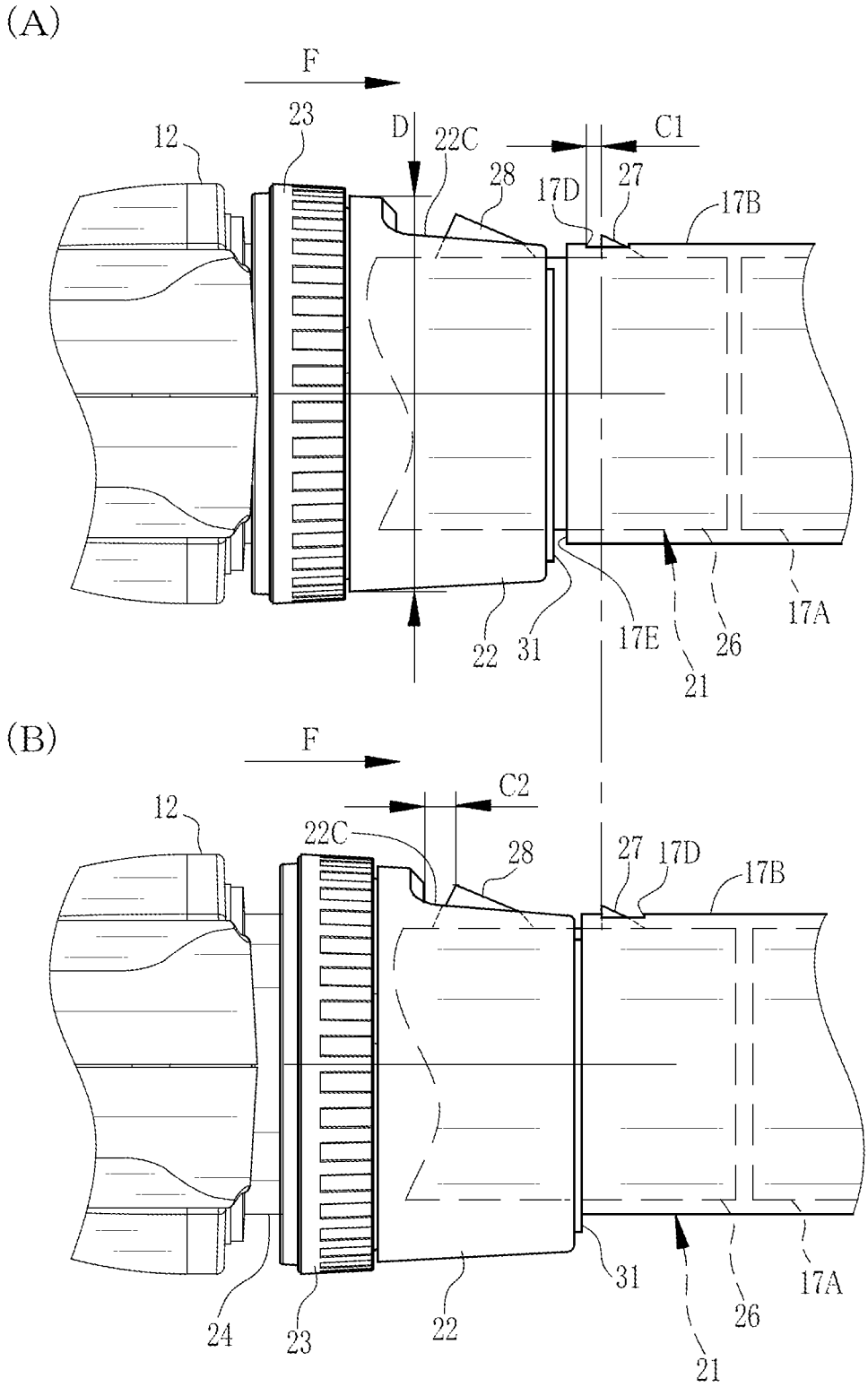
FIG. 5 is an explanatory diagram illustrating an operation of a pre-loading member.

In the position where the engaging hole 17D and the engaging claw 27 are engaged, the connector housing 17B is placed around the connector body 26 (refer to FIG. 5). In this position, the pre-load applying member 22 applies a pre-load to the connector housing 17B by pushing a rear face 17E of the connector housing 17B in the axial direction (refer to FIGS. 3 and 5) with a front face 22B of the pre-load applying member 22.

That is, by pushing the connector housing 17B from the rear side thereof toward the front (the direction indicated by an arrow F in FIG. 5), the engaging hole 17D is pressed against the rear edge of the engaging claw 27, closing a gap between the engaging hole 17D and the engaging claw 27. Thus, the forward movement of the connector housing 17B is restricted by the engaging claw 27, while the rearward movement of the connector housing 17B is stopped by the pressure given from by the pre-load applying member 22 to the rear face 17E. Thus, the movement of the connector housing 17B in the axial direction is restricted, preventing wobbles at the joint between the recorder-side connector 21 and the mikeside connector 17.

The pre-load applying member 22 is made of a plastic resin, for example. Elastic sheets (corresponding to the elastic member) 31, such as rubber sheets, are disposed on the front face 22B of the pre-load applying member 22. The elastic sheets 31 are elastically deformed as the pre-load applying member 22 is pressed against the connector housing 17B, thereby keeping the pre-load applying member 22 instable contact with the connector housing 17B. Furthermore, the elastic sheets 31 give a frictional force to prevent the mikeside connector 17 from turning unexpectedly. Because the pre-load applying member 22 is a plastic member whereas the connector housing 17B is a metal member, the elastic sheets 31 also serve for protecting the front face 22B of the pre-load applying member 22.

The pre-load applying member 22 has such an external diameter D (refer to FIG. 5) that the peak of the release member 28 protruding from the outer periphery of the connector body 26 is approximately even with the outer peripheral surface of the pre-load applying member 22 when the pre-load applying member 22 is joined to the connector body 26. The pre-load applying member 22 is provided with a cutout 22C for exposing the release member 28 to be operable from the outside. The cutout 22C is formed by cutting out apart of the peripheral wall of the pre-load applying member 22 from the front side. The cutout 22C is formed such that the peripheral wall of the pre-load applying member 22 surrounds the release member 28 on three sides except the front side (i.e. on both lateral sides and the rear side), thereby to make it uneasy for the operator to put the finger in the cutout 22C, preventing unintended operations on the release member 28.

The operation ring 23 is a member operated for moving the pre-load applying member 22 in the axial direction. The operation ring 23 also functions as a locking device for locking the pre-load applying member 22 at an appropriate axial position on the connector holder 24. The operation ring 23 is held on the connector holder 24 on the rear side of the pre-load applying member 22 in the axial direction, i.e. on the opposite side of the pre-load applying member 22 from the pre-load applying member 22B.

The operation ring 23 has a thread 23A formed around the inner periphery thereof, so that the operation ring 23 is screwed on the outer periphery of the connector holder 24 as the thread 23A interlocks with the thread 24A on the connector holder 24. As being thus screwed on the connector 24, the operation ring 23 is movable in the axial direction relative to the connector holder 24 by turning the operation ring 23 around the connector holder 24. As the operation ring 23 moves axially forward, the operation ring 23 pushes the pre-load applying member 22 at the rear side to move the pre-load applying member 22 forward. The amount of movement of the pre-load applying member 22 is controlled by adjusting the rotational amount of the operation ring 23. The operation ring 23 has an anti-slip device 23B, such as knurls or flutes, on the outer periphery thereof, preventing fingers from slipping thereon.

Now the operation of the above described structure will be described with reference to FIG. 5. To attach the hand microphone 13 to the voice recorder 11, the front end 26C of the connector body 26 of the recorder-side connector 21 (refer to FIG. 4) is inserted in the connector housing 17B to connect the terminal 17C of the mikeside connector 17 to the terminal 26B of the connector body 26. Then, the engaging claw 27 moves in the connector housing 17B, and is engaged in the engaging hole 17D, as shown in FIG. 5(A).

As shown in FIG. 5(A), if there is a difference between the internal diameter of the connector housing 17B and the external diameter of the connector body 26, the joint would be instable even after the engaging claw 27 is engaged in the engaging hole 17D. There may be a gap C1 between the rear edge of the engaging claw 27 and the engaging hole 17D due to variations in size of the mikeside connector 17. By turning the operation ring 23, the pre-load applying member 22 is movable in the axial direction relative to the connector body 26. Therefore, by turning the operation ring 23 to move the pre-load applying member 22 forward from this position (in the direction indicated by the arrow F), the pre-load applying member 22 is moved close to the connector housing 17B that is joined to the connector body 26. Then, the face end 22B of the pre-load applying member 22 comes into contact with the rear end of the connector housing 17B and pushes the connector housing 17B forward.

If there is the gap C1 between the engaging claw 27 and the engaging hole 17D, the connector housing 17B is moved forward till the gap C1 is closed. Thus, the engaging hole 17D is pushed against the rear edge of the engaging claw 27, as shown in FIG. 5(B), thereby restricting the forward movement of the connector housing 17B. Since the connector housing 17B is pushed from the rear side by the pre-load applying member 22, the rearward movement is also restricted. Consequently, the connector housing 17B is pre-loaded to stabilize the joint between the mikeside connector 17 and the recorder-side connector 21.

As the pre-load applying member 22 is thus movable relative to the connector body 26, even while there are variations in axial length of the connector housing 17B of the mikeside connector 17, it is possible to adjust the amount of movement of the pre-load applying member 22 according to the variations. In addition, by adjusting the amount of movement of the pre-load applying member 22, an appropriate pre-load may be applied to the connector housing 17B.

Furthermore, unlike the conventional push-on type connector, the connector structure 10 is not provided with a coil spring. Therefore, there is no repulsion by the coil spring during the attaching operation. As having no coil spring, the connector structure 10 does not have the problem of changing the biasing force of the coil spring due to variation in axial length of the mikeside connector 17. Accordingly, even if there are variations in axial length of the mikeside connector 17, the connector structure 10 is capable of applying an appropriate pre-load according to the variations, preventing wobbles without fail.

When applying the pre-load to the connector body 26, the pre-load applying member 22 is moved forward relative to the connector body 26. Therefore, in comparison with the position where no pre-load is applied, as shown in FIG. 5(A), a gap C2 between the cutout 22C and a rear edge of the release member 28 is reduced in the position applying the pre-load, as shown in FIG. 5(B). Because the release member 28 in the cutout 22C is enclosed on three sides by the peripheral wall of the pre-load applying member 22, the reduced gap C2 makes it uneasy to put the finger in the cutout 22C, and restricts the amount of depression of the release member 28. Thus, the effect of preventing the operation error becomes greater in the pre-loaded position than in the position without the pre-load.

When the voice recorder 11 starts recording after the hand microphone 13 is attached thereto, sounds and voices captured through the hand microphone 13 are recorded, for example, in the IC memory. Because the hand microphone 13 is kept stable and hence free from rattles, such as contact noises and frictional noises, the recorded audio data is prevented from suffering such noises.

Second Embodiment

Figure 6:
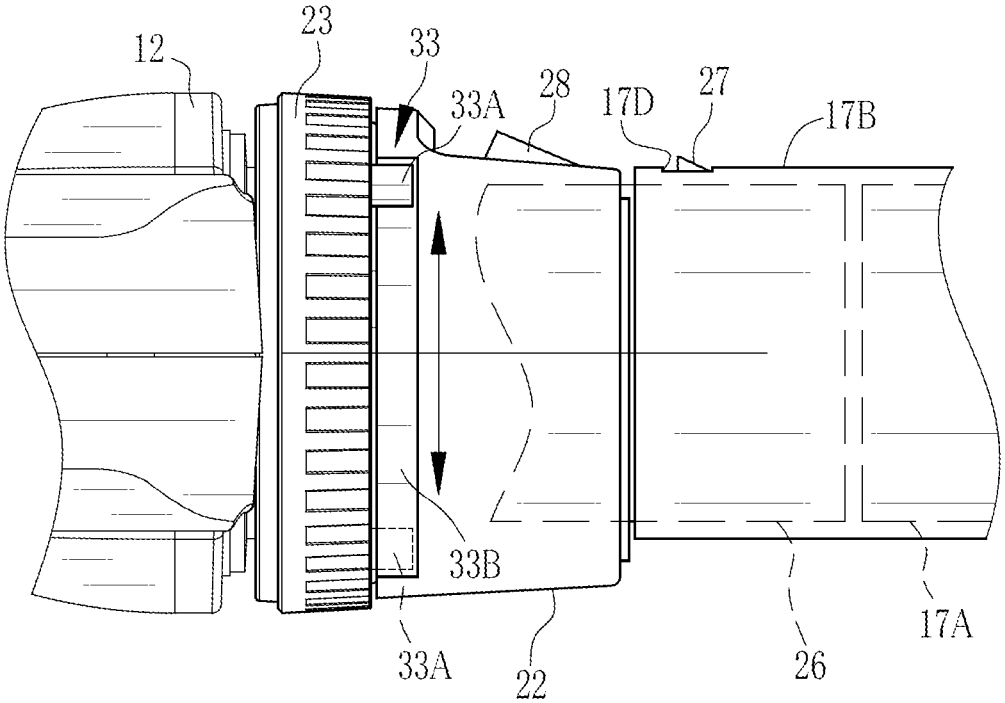
FIG. 6 is an explanatory diagram illustrating a connector structure in accordance with a second embodiment.
Figure 7:
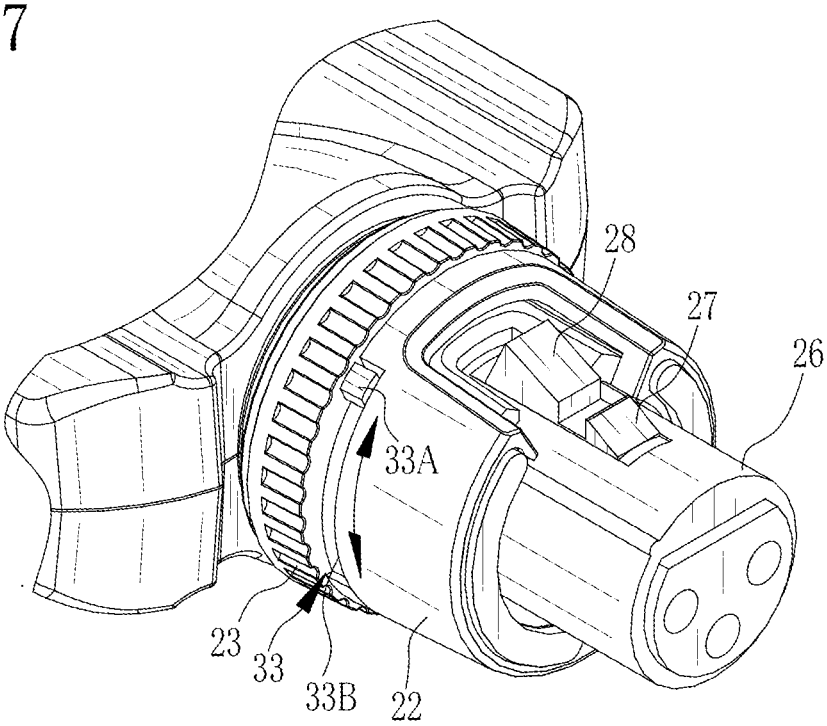
FIG. 7 is a perspective view of the connector structure in accordance with the second embodiment.
Figure 8:
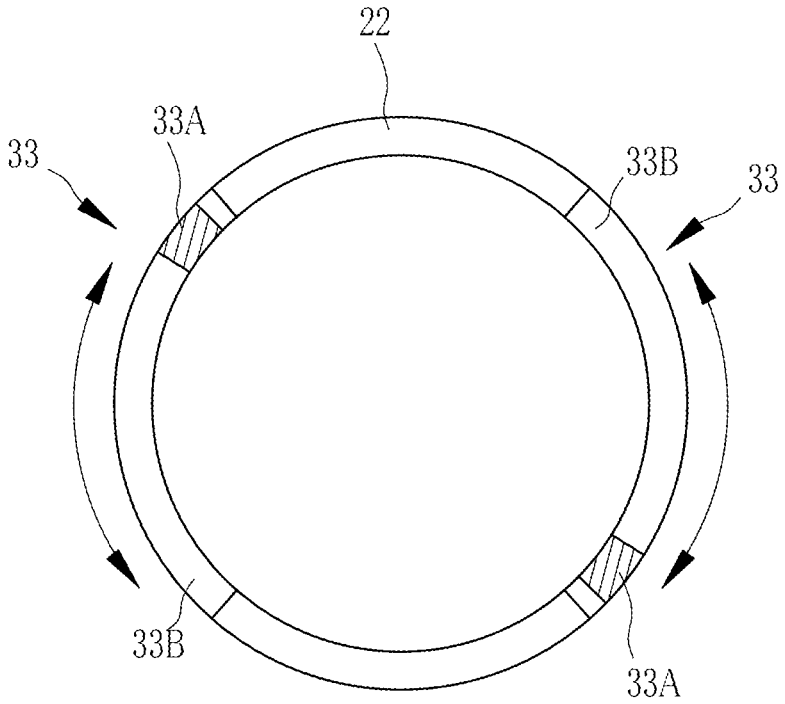
FIG. 8 is an explanatory diagram illustrating an example of arrangement of a rotational amount restriction mechanism.

FIGS. 6 to 8 show a connector structure 10 in accordance with a second embodiment, which is provided with a rotational amount restriction mechanism 33 for restricting the rotational amount of an operation ring 23. Other features of the second embodiment are equivalent to the features of the first embodiment; therefore, same or like parts will be designated by the same reference numerals, and the description of these parts will be omitted in order to concentrate on the different features.

As a pre-load applying member 22 applies a pre-load to the connector housing 17B, the engaging hole 17D puts a load on the engaging claw 27. An operation ring 23 is screwed on the pre-load applying member 22 and moved back and forth by turning the ring 23 thereon. Therefore, the load on the engaging claw 27 can become too large if the operation ring 23 is turned by an excessive amount. The rotational amount restriction mechanism 33 is addressed to prevent this problem.

As shown in FIGS. 6 and 7, the rotational amount restriction mechanism 33 is constituted of a protrusion 33A provided on the operation ring 23 and a stopper slit 33B provided in the pre-load applying member 22. The protrusion 33A protrudes axially forward from the front end of the operation ring 23 into the stopper slit 33B of the pre-load applying member 22. The protrusion 33A rotates together with the operation ring 23. The stopper slit 33B, as being engaged with the protrusion 33A, restricts the rotational amount of the operation ring 23. The movement of the protrusion 33A is restricted in a range between a position drawn by a solid line and a position drawn by a dashed line, as indicated by a double arrow in FIG. 6.

The stopper slit 33B is formed in the rear end of the pre-load applying member 22 to extend in the circumferential direction thereof. The stopper slit 33B is formed in an angular range of 120°, for example. The protrusion 33A is movable within the stopper slit 33B with respect to the angular range, so that the rotational amount restriction mechanism 33 restricts the rotational amount of the operation ring 23 to 120°. As shown in FIG. 8, the rotational amount restriction mechanism 33 may consist of a pair of protrusions 33A and a pair of stopper slits 33B, wherein the protrusions 33A are positioned symmetrically to a center axis of the operation ring 23, whereas the stopper slits 33B extend in the circumferential direction symmetrically to the center axis of the pre-load applying member 22. Thereby, the pre-load applying member 22 is prevented from tilting and thus applies the pre-load in a stable posture.

Although the angular range restricting the rotational amount is set to be 120° in the present example, this value is an example, and the angular range may be more than or less than 120°. The rotational amount restriction mechanism 33 may consist of a single combination of protrusion 33A and stopper slit 33B, or more than two combinations of protrusion 33A and stopper slit 33B. When multiple protrusions 33A and stopper slits 33B are provided, it is preferable to arrange the protrusions 33A and the stopper slits 33B respectively at equal intervals in the circumferential direction of the pre-load applying member 22 in order to suppress the tilt of the pre-load applying member 22. When the rotational amount restriction mechanism consists of a protrusion 33A and a stopper slit 33B, it is possible to widen the angular range up to 320°, for example.

Figure 9:
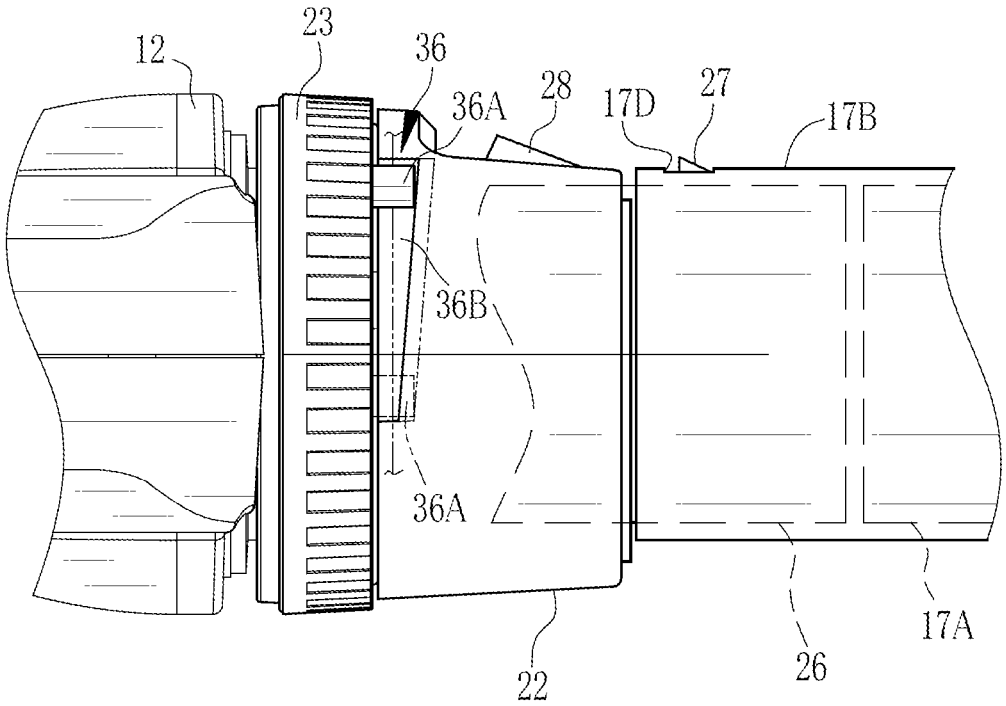
FIG. 9 is an explanatory diagram illustrating a modified example of the rotational amount restriction mechanism.

Furthermore, as shown in FIG. 9, it is possible to provide a rotational amount restriction mechanism 36 which has a tapered stopper slit 36B. Other features of the rotational amount restriction mechanism 36, including a protrusion 36A, may be equal to those of the rotational amount restriction mechanism 33. Specifically, the stopper slit 36B is gradually narrowed in the circumferential direction of the pre-load applying member 22. The protrusion 36A is movable at most from a terminal position drawn by a solid line to another terminal position drawn by a phantom line within the stopper slit 36B. With this movement of the protrusion 36A, the stopper slit 36B and hence the pre-load applying member 22 moves axially from a position drawn by the solid line to a position drawn by a phantom line. Thus, with the rotational amount restriction mechanism 36 using the stopper slit 36B, the amount of axial movement of the pre-load applying member 22 per unit rotational movement of the operation ring 23 (i.e. per unit amount of movement of the protrusion 36A) increases in comparison with that given by the rotational amount restriction mechanism 33 shown in FIG. 6, wherein the stopper slit 33B has a constant width in the circumferential direction. Accordingly, in comparison with that given by the rotational amount restriction mechanism 33 shown in FIG. 6, the rotational amount restriction mechanism 36 provides a greater amount of axial movement of the pre-load applying member 22 without enlarging the angular range of the stopper slit 36B in the circumferential direction.

In the above embodiments, the pre-load applying member 22 and the operation ring 23 for moving the pre-load applying member 22 are formed as separate members, it may be possible to form the pre-load applying member 22 and the operation ring 23 as an integral body. However, if the pre-load applying member 22 and the operation ring 23 are integrated, the pre-load applying member 22 would rotate when coming into contact with the connector housing 17B to apply the pre-load thereto. Therefore, the pre-load applying member 22 could be instable, or an unnecessary load could be given in the rotational direction to the connector housing 17B and the engaging claw 27, among others.

Moreover, in order to avoid interference between the rotating pre-load applying member 22 and the release member 28, the cutout 22C must be wider enough, which leads to lowering the preventive effect against the erroneous operation on the release member 28. To avoid these problems, it is preferable to form the pre-load applying member 22 separately from the operation ring 23.

In the above embodiments, the operation ring 23 is provided to cause the pre-load applying member 22 to move in the axial direction by operating the operation ring 23. However, the operation ring 23 is not essential, but may be replaced by a locking device for locking the pre-load applying member 22 at an appropriate position in the axial direction. For example, as such a locking device other than the operation ring 23, it may be possible to use a screw like the screw 29 shown in FIG. 4. In that case, the pre-load applying member 22 may be moved to an appropriate position and then fixed at this position by the screw. Of course, the configuration using the operation ring 23 is preferred to the configuration using the screw. Because the operation ring 23 is fixed at a moved-in position due to the screw-engagement between the threads 23A and 24A, there is no need for a specific operation to fix the position of the operation ring 23 by a screw or like, providing superior operability.

The above embodiments have been described with reference to those examples wherein the first engaging portion provided in the mikeside connector is an engaging hole, whereas the second engaging portion provided in the recorder-side connector is an engaging claw, the engaging hole and the engaging claw is replaceable with each other.

The present invention is not to be limited by the above embodiments but may be modified, as appropriate, without departing from the subject matter of the present invention, for example, by combining any of the above embodiments and modifications.

What is claimed is:

1. A connector structure for attaching an external microphone to a voice recorder that records sounds and voices, the external microphone inputting sounds and voices to the voice recorder, the connector structure comprising:

a recorder-side connector provided in the voice recorder so as to be connectable to a mikeside connector of the external microphone, the recorder-side connector comprising a connector body having a shaft-like shape, of which a front end portion is to be inserted in a tubular cylindrical connector housing of the mikeside connector, and a second engaging portion which is provided on the connector body so as to be engaged with a first engaging portion of the connector housing when the connector body is inserted in the connector housing, thereby to prevent removal of the mikeside connector from the recorder-side connector;

a pre-load applying device that applies a pre-load to the connector housing by pushing a rear end face of the connector housing in an axial direction of the connector body while the first engaging portion is engaged with the second engaging portion and the connector housing is located around the outer periphery of the connector body;

a holder housing that has a tubular cylindrical shape capable of holding a rear end portion of the connector body therein and holds the pre-load applying device thereon so as to be movable in the axial direction; and a locking device for locking the pre-load applying device at an appropriate axial position on the holder housing.

2. The connector structure as set forth in claim 1, wherein the pre-load applying device is a member of a tubular cylindrical shape that is capable of holding a portion of the connector body therein.

3. The connector structure as set forth in claim 2, wherein the locking device is an operation ring for causing the pre-load applying device to move in the axial direction, the operation ring being placed on the rear side of the pre-load applying device in the axial direction and screwed on the outer periphery of the holder housing such that the operation ring is moved in the axial direction by being turned around the holder housing, thereby enabling to adjust the axial position of the pre-load applying device.

4. The connector structure as set forth in claim 3, wherein the pre-load applying device is provided with an elastic member on a face end that is brought into contact with the rear end face of the connector housing.

5. The connector structure as set forth in claim 3, wherein the second engaging portion is mounted to be capable of protruding out of and retracting into the outer periphery of the connector body, the connector body is provided with a release member for releasing the engagement of the second engaging portion from the first engaging portion by depressing the second engaging portion into the connector body, the release member being disposed on the rear side of the second engaging portion and protruding outward from the outer periphery of the connector body; and the pre-load applying device has such an external diameter that the height of the release member protruding from the outer periphery of the connector body is approximately even with the outer peripheral surface of the pre-load applying device, and has a cutout for exposing the release member to be operable from the outside, the cutout being formed by cutting out a part of a peripheral wall of the pre-load applying device from the front side so as to surround the release member on three sides except the front side.

6. The connector structure as set forth in claim 3, further comprising a rotational amount restriction mechanism for restricting the rotational amount of the operation ring.

* * * * *